US011008151B1

(12) United States Patent
Lobisser

(10) Patent No.: US 11,008,151 B1
(45) Date of Patent: May 18, 2021

(54) CYLINDRICAL VESSEL FOR LOW PRESSURE STORAGE OF PERISHABLE GOODS FABRICATED FROM NEAT OR REINFORCED PLASTICS

(71) Applicant: RIPELOCKER LLC, Bainbridge Island, WA (US)

(72) Inventor: G. Kyle Lobisser, Bainbridge Island, WA (US)

(73) Assignee: Ripelocker LLC, Bainbridge Island, WA (US)

( * ) Notice: Subject to any disclaimer, the term of this patent is extended or adjusted under 35 U.S.C. 154(b) by 23 days.

(21) Appl. No.: 15/923,611

(22) Filed: Mar. 16, 2018

Related U.S. Application Data

(60) Provisional application No. 62/472,316, filed on Mar. 16, 2017.

(51) Int. Cl.
*B65D 81/20* (2006.01)
*B65D 19/00* (2006.01)
*B65D 85/34* (2006.01)

(52) U.S. Cl.
CPC ..... *B65D 81/2015* (2013.01); *B65D 19/0004* (2013.01); *B65D 85/34* (2013.01); *B65D 2519/00034* (2013.01); *B65D 2519/00069* (2013.01)

(58) Field of Classification Search
CPC ..... B65D 19/0004; B65D 81/2015; B65D 85/34; B65D 2519/00034; B65D 2519/00069
USPC ..... 206/386, 524.8
See application file for complete search history.

(56) References Cited

U.S. PATENT DOCUMENTS 3,418,783 A * 12/1968 Collons ..... B65D 81/2015 53/432
4,591,055 A * 5/1986 Corn ..... B65D 81/2015 116/200
4,643,314 A * 2/1987 Kidd ..... B65D 19/06 206/386
5,111,938 A * 5/1992 Soprano ..... B65F 1/1615 206/386
5,450,998 A * 9/1995 Esse ..... B65D 5/606 229/122.21
5,487,471 A * 1/1996 Marchek ..... B65D 19/06 206/386
6,536,192 B2 * 3/2003 King ..... B65D 51/26 206/349
2009/0230012 A1 * 9/2009 Choy ..... B65D 81/2023 206/524.8

(Continued)

*Primary Examiner* — Luan K Bui
(74) *Attorney, Agent, or Firm* — Æon Law; Adam L. K. Philipp; Martin Spencer Garthwaite

(57) ABSTRACT

A vacuum container for containing perishable items in controlled, reduced pressure, atmospheric conditions is provided. The vacuum container includes a section of generally cylindrical pipe open at both ends and formed of a plastic material. A first end cap is detachably secured to one end of the pipe to form a vacuum resistant seal between the first end cap and the pipe. A second end cap detachably secured to the other end of the pipe to form a vacuum resistant seal between the second end cap and the other end of the pipe. Preferably, the pipe and end caps are all formed of a plastic material capable of withstanding the pressures created when a high vacuum is formed in the chamber.

16 Claims, 4 Drawing Sheets

(56) References Cited

U.S. PATENT DOCUMENTS

| | | | | |
|---|---|---|---|---|
| 2011/0132801 | A1* | 6/2011 | Elder | B65D 19/18<br>206/600 |
| 2015/0108037 | A1* | 4/2015 | Evans | B65D 19/18<br>206/600 |

* cited by examiner

CYLINDRICAL VESSEL FOR LOW PRESSURE STORAGE OF PERISHABLE GOODS FABRICATED FROM NEAT OR REINFORCED PLASTICS

CROSS REFERENCE TO RELATED APPLICATIONS

This patent application claims the benefit of and priority to U.S. Provisional Patent Application Ser. No. 62/472,316 filed on Mar. 16, 2017, entitled, "CYLINDRICAL VESSEL, FORMED FROM NEAT OR REINFORCED PLASTICS, FOR LOW PRESSURE STORAGE OF PERISHABLE GOODS" the disclosure of which is hereby incorporated by reference for all purposes.

FIELD OF THE INVENTION

The invention relates to systems, methods and apparatus for controlling environmental conditions within a sealed chamber for preserving perishable products.

BACKGROUND

It has been determined by Stanley P. Burg that by placing perishable items in vacuums under low pressure between approximately 10 to 150 Torr, in combination with refrigeration, the degradation or senescence of the perishable can be significantly slowed as compared to refrigeration alone. However, to implement low pressure storage of perishable items on a commercially practical scale requires vacuum chambers that are not only able to withstand the forces caused by a high vacuum within the chamber but ones that can be easily and economically fabricated as well.

The storage and shipment of perishable goods currently takes place primarily on rectangular pallets and within rectangular boxes or reusable plastic containers (RPC). The reasons for this are obvious; the buildings in which produce is packed and stored are rectangular, the trucks that transport the pallets use rectangular trailers, and for longer journeys, the boats and rail cars use rectangular containers. To maximize the packing efficiency along the entire distribution chain, rectangular pallets are used. While there is no universally accepted standards for the exact dimensions of pallets, they are most commonly rectangular or square in shape.

SUMMARY OF THE INVENTION

The invention is directed to apparatus and methods for placing and keeping harvested fruits, vegetables and other perishable commodities in a vacuum environment from shortly after they are harvested until shortly before they are offered for retail sale.

In one aspect, the invention is directed to the construction, fabrication and implementation of transportable vacuum chambers that can be easily and economically fabricated. In particular, the invention is directed to transportable vacuum chambers for use in placing and keeping harvested fruits, vegetables and other perishable commodities in a vacuum environment following harvest and during transport, wherein the vacuum chambers are easily and economically fabricated largely from existing components and materials.

In another aspect, the invention relates to the design, manufacturing methods, and application of a cylindrical vacuum vessel used for the storage and transport of perishable goods under low pressure conditions.

These and other features and advantages will be apparent from a reading of the following detailed description and a review of the associated drawings. It is to be understood that both the foregoing general description and the following detailed description are explanatory only and are not restrictive. Among other things, the various embodiments described herein may be embodied as methods, devices, or a combination thereof. The disclosure herein is, therefore, not to be taken in a limiting sense.

DETAILED DESCRIPTION

Figure 1:
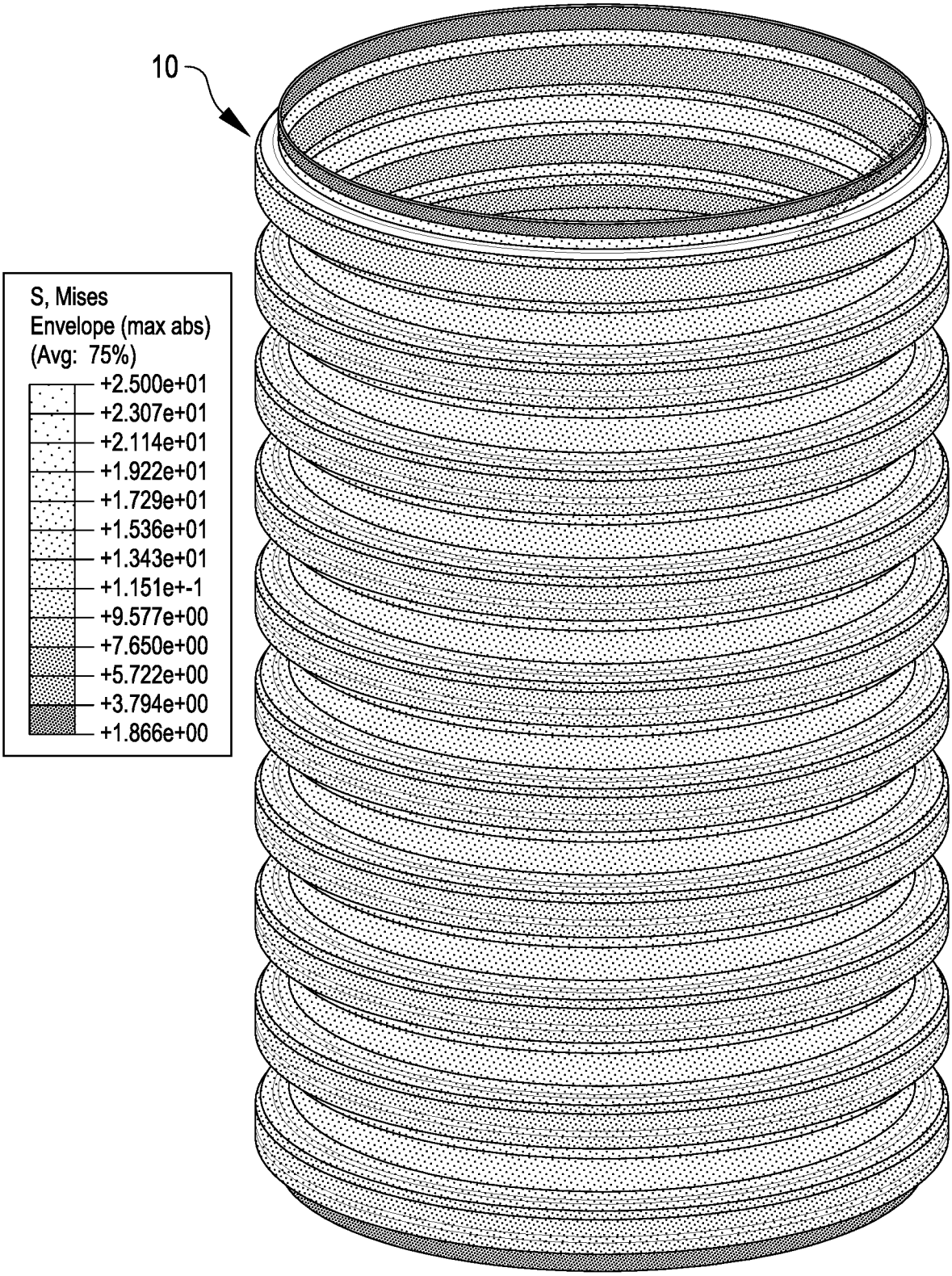
FIG. 1 is a contour plot showing stress distribution in a cylindrical structure from equivalent pressure loading analyzed using Finite Element Analysis (FEA).

Various embodiments will be described in detail with reference to the drawings, wherein like reference numerals represent like parts and assemblies throughout the several views. Many details of certain embodiments of the disclosure are set forth in the following description and accompanying figures so as to provide a thorough understanding of the embodiments. Reference to various embodiments does not limit the scope of the claims attached hereto. Additionally, any examples set forth in this specification are not intended to be limiting and merely set forth some of the many possible embodiments for the appended claims.

Cubic shaped pallets and containers are most efficient for transporting goods when accounting for packing efficiency and logistics standards. However, cubic shaped structures are significantly less efficient reacting loads due to the application of high or low pressure. Pressurized gas cylinders are an example of a high pressure vessel, where walls are loaded primarily in tension due to outward pressure of the contained gas. A submarine under water is an example of a low pressure vessel, where the walls are loaded in compression due to the hydrostatic forces acting on all surfaces. Structural efficiency can be quantified by the amount of material used in the structure, the weight of the resulting structure, complexity of the design, and the subsequent cost. Cubic shaped pressure vessels are very rare, and used only when packaging requirements necessitate a specific shape, or loads (pressures) are low, or the size is small. FIG. 1 shows examples of a cylindrical and square-shaped pressure vessel subject to a 1 atmosphere pressure load.

FIG. 1 is a contour plot showing stress distribution in a cylindrical structure 10 from equivalent pressure loading analyzed using Finite Element Analysis (FEA). As shown, stress levels throughout the structure range consistently and evenly between 5-9 MPa.

Figure 2:
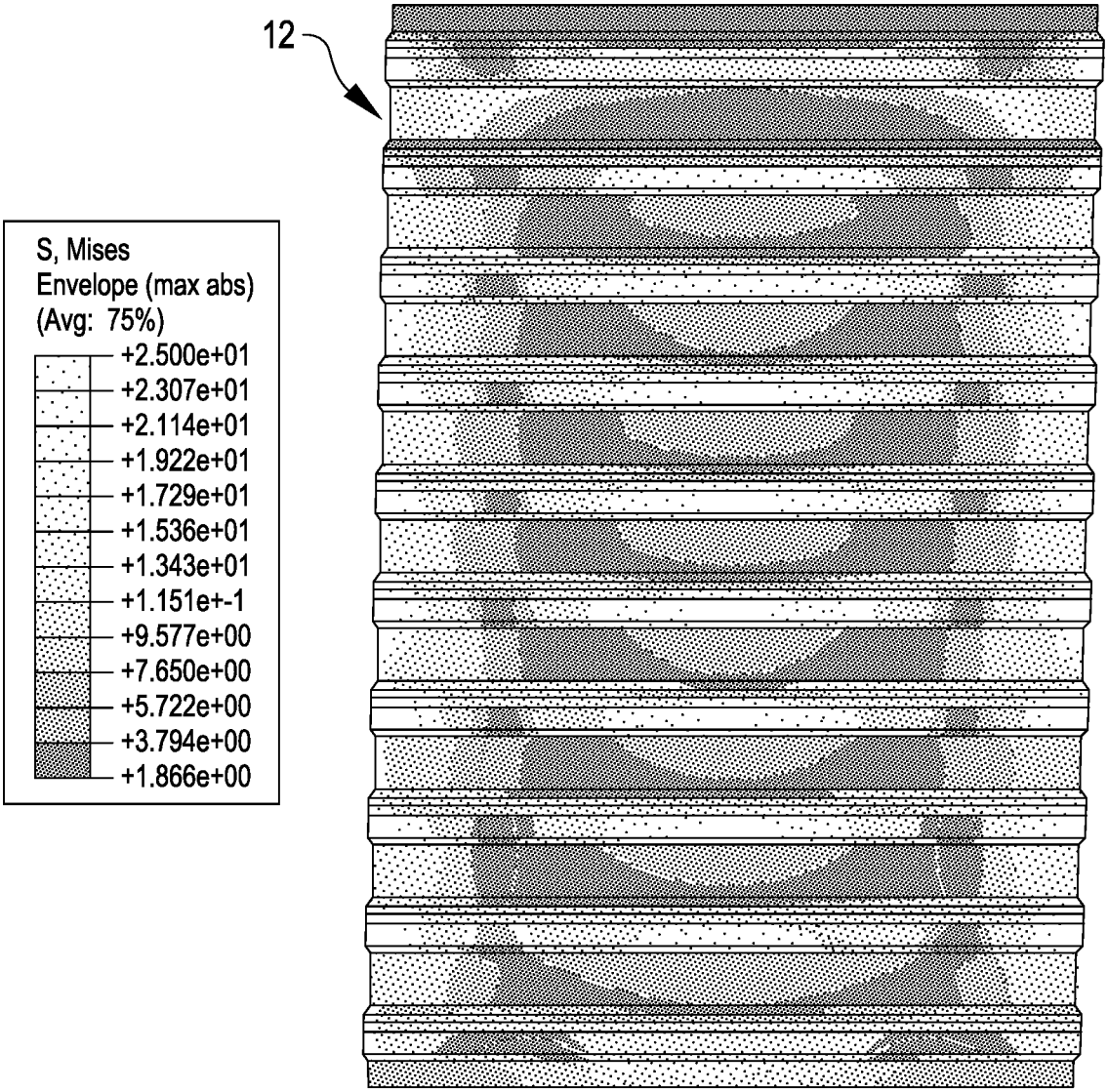
FIG. 2 is a contour plot, similar to FIG. 1, showing stress distribution in the rectangular wall of a cubic container subject to the same pressure loads as in FIG. 1.

FIG. 2 is also a contour plot, similar to FIG. 1, this time showing stress distribution in the rectangular wall of a cubic container 12 subject to the same pressure load of 1 atmosphere. As illustrated, the stresses vary dramatically throughout the structure due in large part to the resultant bending stresses. At the corners and at mid span, stress levels exceed the yield strength of the material, which in this case is ~25 MPa. In other areas, stresses are negligible. This is an example of an inefficient structure, and significant internal reinforcement is necessary to make the box capable of withstanding the loads resulting in increased weight and cost.

Materials

Atmospheric pressure is ~14 psi at sea level, multiple orders of magnitude lower than the typical operating pressure of a high pressure tank (3,000 psi). While most high pressure tanks are manufactured from exotic composites or high strength metallic materials, the relatively low pressures of a vacuum chamber allow for cheaper materials to be employed including commodity grade thermoplastics. Candidate polymers include PP, HDPE, and PVC. While thermoplastic polymers like PP, HDPE, and PVC provide exceptional manufacturing rates, toughness, and low cost, they have low strength and are prone to suffer from creep during extended periods of applied force, even if this force results in stress well below the typical yield point. The reduced modulus and strength due to creep can lead to permanent deformation of the chamber, which can lead to loss of seal or structural stability. To further enhance the strength and stiffness of these materials, and to reduce the effects of creep, fillers including discontinuous glass or carbon fibers can be added to the polymers during the compounding process yielding a cheap composite material capable of high rate manufacturing.

Metallic materials such as aluminum and steel do not suffer from creep, and can be valid candidate materials for vacuum vessels as well. However, other issues including weight, difficulty maintaining seal following the manufacturing process, and cost do make them less attractive candidates.

Thermosetting polymers including, but limited to, epoxy, vinyl ester, and polyester are also immune to the effects of creep. When reinforced with high strength, continuous fibers such as glass or carbon, these composite materials are extremely strong and stiff, and can result in reduced wall thickness and weight of the structure. However, thermosetting polymers inherently take more time to cure, which reduces the manufacturing rate of the vessels while increasing cost. They also have lower toughness than thermoplastic polymers, which can be a problem when considering the abuse due to common shipping conditions.

Architecture

Low pressure (vacuum) vessel architecture differs dramatically from high pressure vessel design. Due to primarily compressive stress, the chamber architecture must provide adequate stiffness to prevent buckling of the walls or collapsing due to a geometric instability. In a single wall chamber, the wall thickness must be adequate to provide necessary stiffness and strength. For unreinforced thermoplastic materials, a single wall vessel of 36" diameter would need 0.4-0.5" wall thickness, although wall thickness can, depending upon application pressure, range between 0.10 and 1.00 inches.

To further enhance stiffness and increase buckling loads, additional layers of material can be added to the vessel. These additional walls can be shaped or corrugated to intermittently contact the inner liner and reduce the lengths of unsupported material span. The chamber can be extruded in a method similar to the now common large diameter plastic drainage pipes, and have 1-3 thinner layers of walls. When multiple plies, or layers of material are used, the total wall thickness can be thinner than a single ply architecture. This results in reduced cost, weight, and improved damage tolerance over single wall chamber designs. These benefits are again realized because of the additional stiffening characteristics of a shaped wall, which increases resistance of the structure to buckling.

Stronger and stiffer metallic and higher performance composite materials may be capable of withstanding the loads using much thinner walls. However, a single wall provides little resistance to abuse loads and can be more prone to leaking. In general, metallic and thermosetting composite materials take more time to fabricate than commodity grade thermoplastics.

The diameter of the chamber can be 30 to 48 inches, designed to fit on most common pallets. Heights of the chamber can range from 12 to 80 inches, common to most pallet shipments or perishables storage. It will be appreciated, however, that depending upon the application and goals, the chambers can be of other sizes as well.

Internal & External Support Structure

To manage large axial loads induced from the lid and base of the pipe or chamber, a central column may be placed along the central axis of the chamber spanning the two end structures. This support column will reduce axial loading in the walls of the chamber, which can lead to buckling and damage of the chamber. A small diameter but thick-walled internal structure such as an aluminum column can manage the applied axial loads more efficiently than the thin walls of the chamber. Depending on the strength and stiffness of the chamber and end structures, a plurality of internal support columns can be used. The distribution of these columns can be optimized depending on the design of the end structures and chambers If necessary, up to 5 columns may be used to manage the axial loads and reduce stress in the chamber walls.

In addition, longitudinal stringers of a higher strength and stiffness can be integrally molded into the walls of the plastic chamber. Conversely, so as not to affect useful storage area of the chamber, the support structure can be placed outside the vessel but near the vessel walls to improve load-bearing performance.

Pallet Base and Lid

The pallet base may look similar to existing pallets on the market today, with 4-way forklift entrance and sturdy legs. However, the loads to the vacuum far exceed the weight of any amount of supported fruit, so the pallet must be extremely strong and stiff. For example, the forces acting on the pallet base and lid exceed 14,000 pounds under full vacuum. The pallet architecture is based around known twin-sheet thermoforming technology, using integrally formed steel or aluminum stringers to react the out-of-plane vacuum forces.

HDPE is an attractive material for these vacuum pallet bases for a number of reasons. First, HDPE is exceptionally tough and resistant to damage. It also has extremely low permeability, meaning lower vacuum leak rates of the chamber. It is also very cheap, and easily formed using a number of processes.

To improve the performance of HDPE, fillers such as glass or carbon fibers can be added to the base resin. The resultant structure will be stronger and stiffer when compared to the same manufactured from unreinforced HDPE.

Other candidate materials include PP, PVC, and thermosetting polymers with various levels from reinforcement from 5%-60% by weight.

A separate lid may be conic or convex in shape to maintain stability and strength, without the need for metallic stringers. Or, the base pallet can be used as a lid, to minimize necessary part numbers and/or tooling costs.

Example Assemblies

Figure 3:
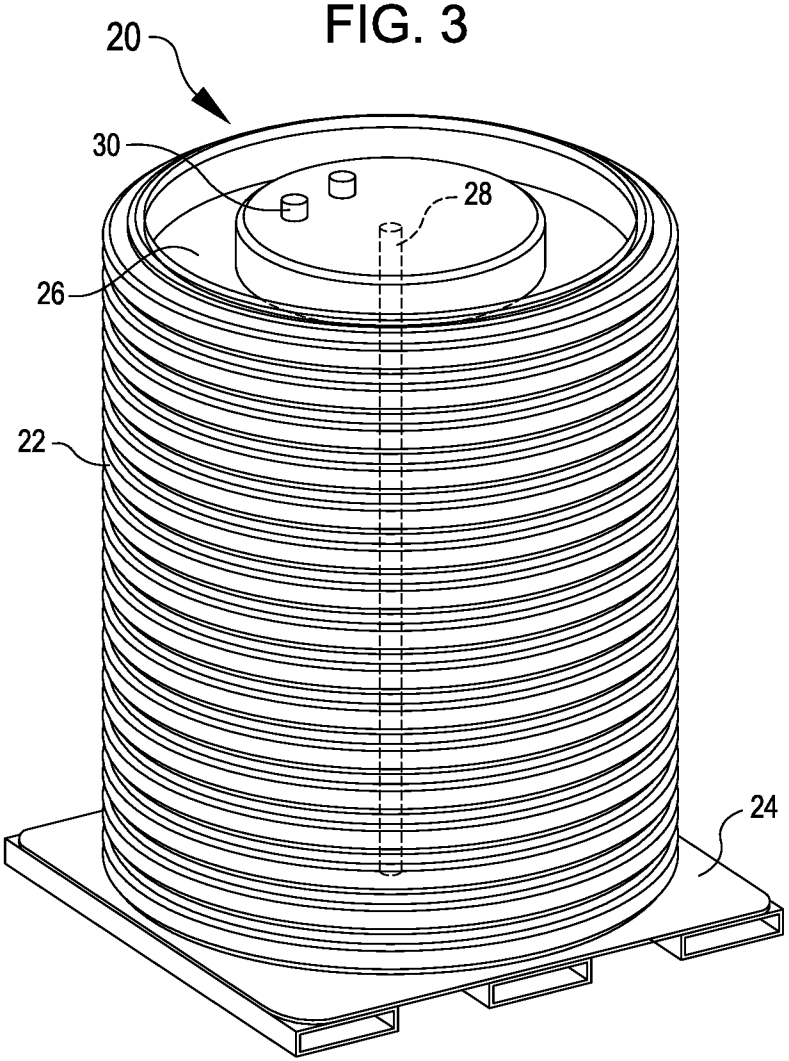
FIG. 3 is a perspective view of one embodiment of a cylindrical vessel for low pressure storage of perishable goods constructed in accordance with one aspect of the invention.

FIG. 3 depicts one embodiment of a cylindrical vessel 20 for low pressure storage of perishable goods constructed in accordance with one aspect of the invention.

As shown in FIG. 3, the cylindrical vessel includes a section of cylindrical large diameter corrugated plastic drainage pipe 22 having 1, 2 or 3 thinner layers of walls. The pipe is formed of a polymer, such as PP, HDPE, or PVC. Each layer of material ranges from 0.05" to 0.25". Where the material joint together, the total wall thickness may exceed ¼". The diameter of the pipe is preferably between 30 and 48 inches so as to fit on most common pallets. Preferably, the height of the chamber ranges from 12 to 80 inches, common to most pallet shipments or perishables storage.

As further illustrated in FIG. 3, the pipe rests on a generally square or rectangular pallet 24 that is preferably formed of Carbon reinforced HDPE. In the illustrated embodiment, the pallet is generally square and configured to be transported by standard fork trucks. The upper end of the pipe is fitted with a generally circular flat top or lid 26 that, after placement over the top end of the pipe 22, is sealed so as to permit the formation of a vacuum within the vessel. A seal is also provided between the lower end of the pipe and the upper surface of the pallet to help maintain the vacuum.

As further illustrated in FIG. 3, the vessel includes an interior support 28 that, in the illustrated embodiment, consists of a rigid cylindrical rod extending upwardly along the central axis of the pipe from the top of the pallet to the underside of the top or lid. The support can be formed of other suitable, rigid materials such as metal or higher performance composites. Various ports 30 are preferably provided in the top or lid to permit the attachment of such apparatus as vacuum pumps, sensors, gas inlets and other devices for monitoring and controlling the atmosphere within the vessel.

Figure 4:
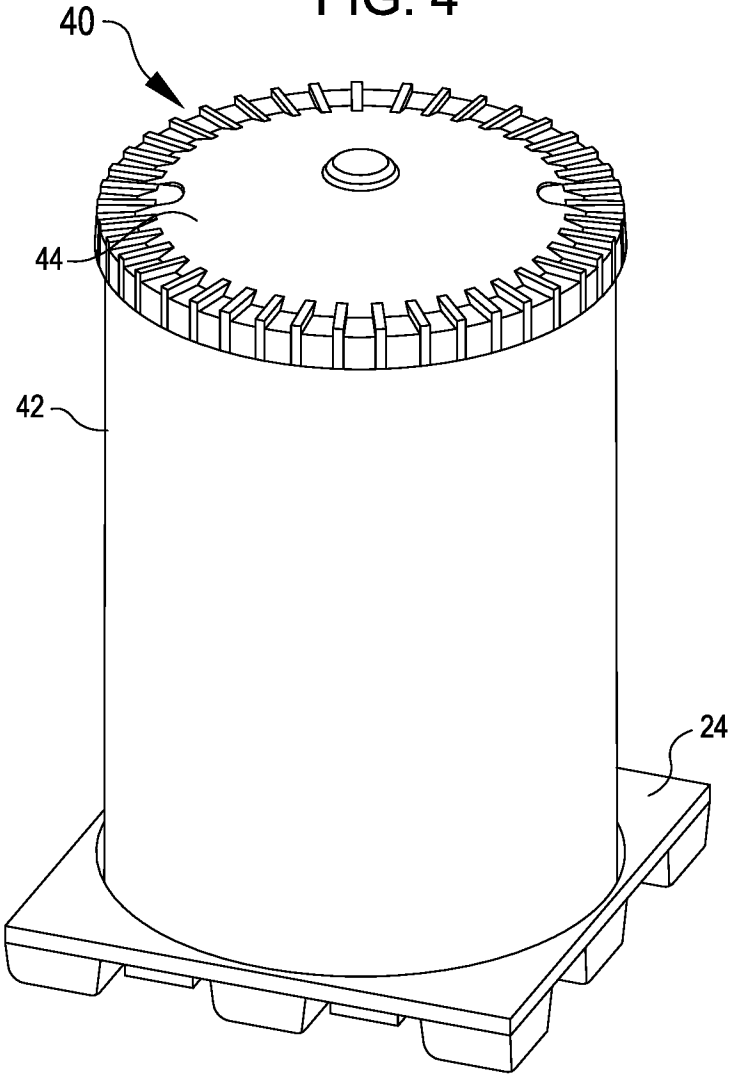
FIG. 4 is a perspective view of one embodiment of a cylindrical vessel for low pressure storage of perishable goods constructed in accordance with another aspect of the invention.

FIG. 4 depicts another embodiment of a cylindrical vessel 40 wherein the pipe section 42 is of a single layer configuration and wherein the top or lid 44 is of a convex shape. Again, the top or lid and the upper section of the pipe are detachably sealed to each other to maintain a vacuum within the vessel, as are the lower portion of the pipe and the pallet on which the pipe rests. The convex shape of the top or lid helps withstand the external pressures resulting from the formation of a vacuum within the vessel that allows the central support to be dispensed with. Alternatively, the central support can be included to further withstand the pressures that result. Furthermore, the lid can be concave in shape resulting in a state of tensile stress as opposed to compressive.

Figure 5:
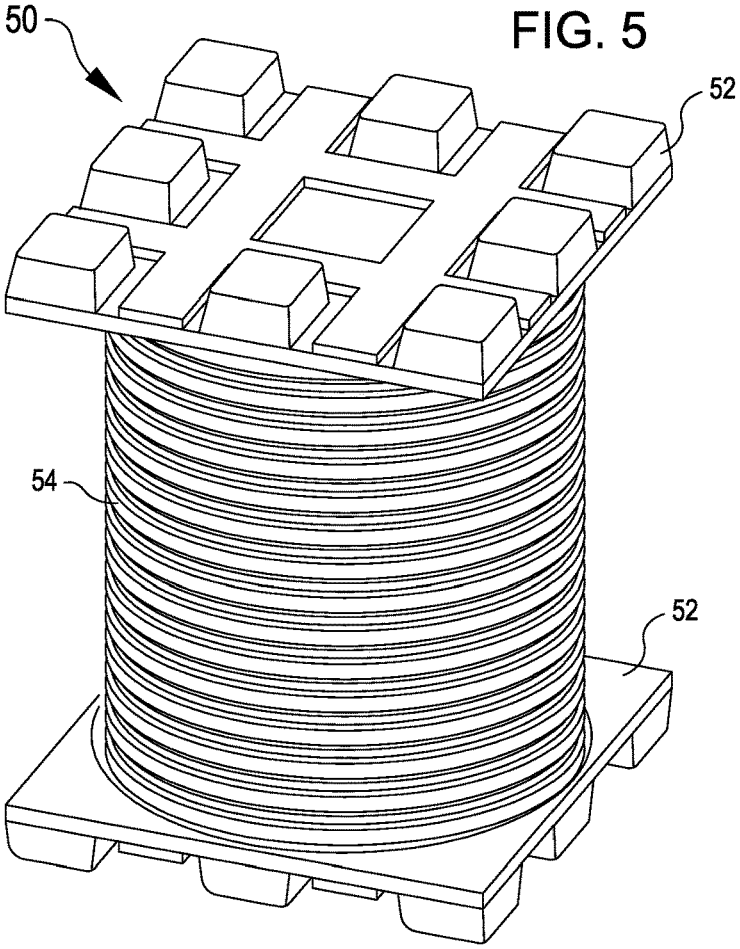
FIG. 5 is a perspective view of one embodiment of a cylindrical vessel for low pressure storage of perishable goods constructed in accordance with another aspect of the invention.

FIG. 5 depicts another embodiment of a cylindrical vessel 50 wherein a single pallet design 52 is used to seal both the upper and lower ends of the pipe 54. In this embodiment, the pipe is of a double or triple layer plastic design, and each of the upper and lower pallets are substantially the same. This has the advantage that sealing of the pipe can be accomplished with a single pallet design, resulting in reduced manufacturing costs and ease of use, in that a single inventory of pallets can be provided for sealing both ends of the pipe. Again, the top or lid and the upper section of the pipe are detachably sealed to each other to maintain a vacuum within the vessel, as are the lower portion of the pipe and the pallet on which the pipe rests. These thermoformed plastic pallets may include metallic stringers for additional strength.

Figure 6:
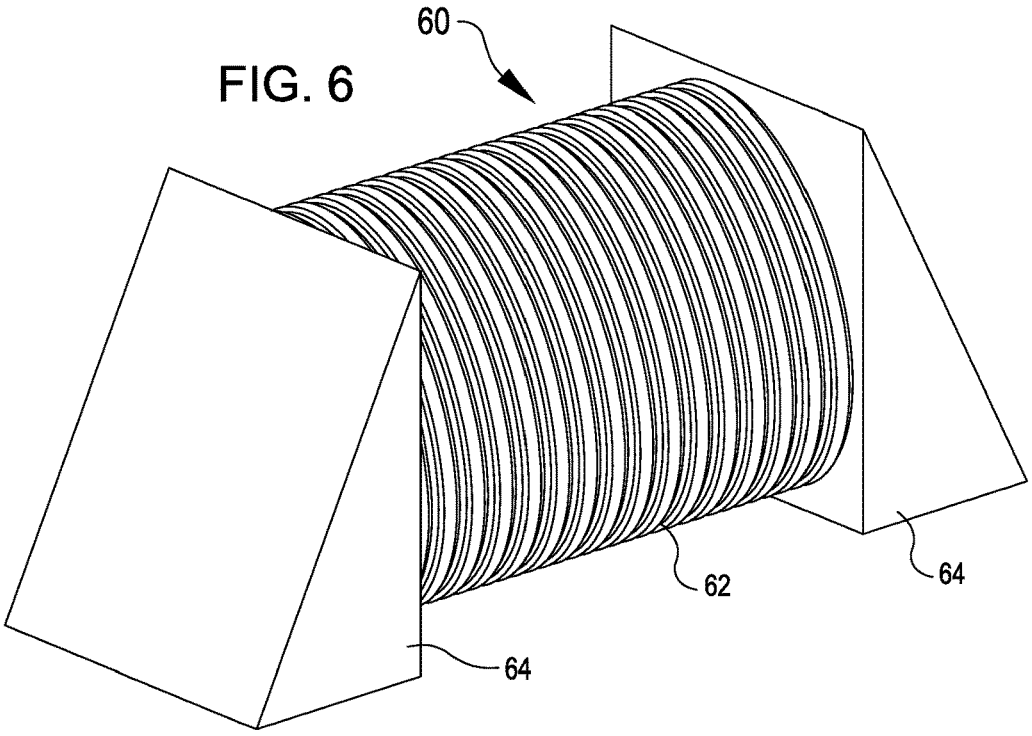
FIG. 6 is a perspective view of one embodiment of a cylindrical vessel for low pressure storage of perishable goods constructed in accordance with another aspect of the invention.

FIG. 6 depicts another embodiment of a cylindrical vessel 60 constructed in accordance with one aspect of the invention. In this embodiment, the chamber axis defined by the pipe 62 is aligned horizontally with the ground, with the end caps 64 supported using external framing. This allows for a longer vessel, statically affixed to the floor. Critical axial loads are managed by the framing supporting the end caps, as opposed to the walls of the vessel. The design and architecture of the end supports are not covered in detail at this time, but eliminate the need for central support columns within the chamber.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The invention claimed is:

1. A vacuum container for containing perishable items in controlled, high vacuum conditions, said vacuum container comprising: a section of stiff cylindrical pipe open at both ends and formed of a plastic material; a first end cap detachably secured to one end of the section of stiff cylindrical pipe in sealing engagement therewith to form a vacuum resistant seal between the first end cap and the one end of the section of stiff cylindrical pipe; and a second end cap detachably secured to the other end of the section of stiff cylindrical pipe in sealing engagement therewith to form a vacuum resistant seal between the second end cap and the other end of the section of stiff cylindrical pipe; wherein the high vacuum conditions comprise pressure within a range of 10 and 140 Torr within the vacuum container, and wherein to resist the high vacuum conditions without buckling or collapse over time, the section of stiff cylindrical pipe is cylindrical to be geometrically stable against compressive forces and comprises at least two layers formed of the plastic material, wherein a first layer of the at least two layers formed of the plastic material is straight-walled and a second layer of the at least two layers formed of the plastic material comprises horizontally oriented corrugations.

2. The vacuum container of claim 1, wherein the section of stiff cylindrical pipe is substantially straight-walled.

3. The vacuum container of claim 1, wherein the section of stiff cylindrical pipe is formed of a polymer.

4. The vacuum container of claim 3, wherein the polymer comprises at least one of polypropylene, high density polyethylene, and polyvinyl chloride.

5. The vacuum container of claim 1, wherein the first end cap is a pallet of generally rectangular shape.

6. The vacuum container of claim 5, wherein the second end cap is of generally circular shape.

7. The vacuum container of claim 6, wherein the second end cap is convex.

8. The vacuum container of claim 5, wherein the second end cap is a pallet of generally rectangular shape.

9. The vacuum container of claim 1, wherein the first and second end caps are of substantially similar shape and configuration.

10. The vacuum container of claim 1, further including a support within the section of stiff cylindrical pipe for withstanding external pressure experienced by the first and second end caps, wherein the support comprises a rod extending from the first end cap to the second end cap.

11. The vacuum container of claim 10, wherein the rod is one of a plurality of supports within the section of stiff cylindrical pipe to withstand external pressure experienced by the first and second end caps.

12. The vacuum container of claim 1, wherein the section of stiff cylindrical pipe is a section of commercially available drainage pipe.

13. The vacuum container of claim 1, wherein the first and second end caps are formed of carbon reinforced high density polyethylene.

14. The vacuum container of claim 1, wherein the first and second end caps are formed of a plastic integrally thermoformed around metallic stringers.

15. The vacuum container of claim 1, wherein the first and second end caps support the section of stiff cylindrical pipe in a substantially horizontal orientation.

16. The vacuum container of claim 1, wherein the horizontally oriented corrugations distribute compressive stress consistently and evenly within the section of stiff cylindrical pipe below a yield strength of the plastic.

* * * * *